US012085343B2

(12) United States Patent
Bilek et al.

(10) Patent No.: US 12,085,343 B2
(45) Date of Patent: Sep. 10, 2024

(54) PROFILE FOR A HEADER OF A COOLER, A HEADER HAVING SUCH A PROFILE AND A COOLER HAVING A HEADER

(71) Applicant: Hanon Systems, Daejeon (KR)

(72) Inventors: Martin Bilek, Veseli nad Moravou (CZ); Milan Kolomaznik, Hluk (CZ); Lukas Prochazka, Stare Mesto u UH (CZ)

(73) Assignee: HANON SYSTEMS, Daejeon (KR)

( * ) Notice: Subject to any disclaimer, the term of this patent is extended or adjusted under 35 U.S.C. 154(b) by 349 days.

(21) Appl. No.: 17/423,167

(22) PCT Filed: Apr. 13, 2020

(86) PCT No.: PCT/KR2020/095066

§ 371 (c)(1),
(2) Date: Jul. 15, 2021

(87) PCT Pub. No.: WO2020/242280

PCT Pub. Date: Dec. 3, 2020

(65) Prior Publication Data

US 2022/0128308 A1 Apr. 28, 2022

(30) Foreign Application Priority Data

May 29, 2019 (DE) ..... 10 2019 207 905.9

(51) Int. Cl.

| | |
|---|---|
| ***F28D 1/053*** | (2006.01) |
| ***F28F 9/02*** | (2006.01) |
| *F24H 1/28* | (2022.01) |
| *F28D 7/16* | (2006.01) |
| *F28D 21/00* | (2006.01) |
| *F28F 9/013* | (2006.01) |

(52) U.S. Cl.

CPC ..... *F28D 1/05366* (2013.01); *F28F 9/0224* (2013.01); *F24H 1/287* (2013.01); *F28D 7/16* (2013.01); *F28D 21/0007* (2013.01); *F28D 2021/0091* (2013.01); *F28F 9/0131* (2013.01); *F28F 9/0217* (2013.01); *F28F 9/0219* (2013.01); *F28F 9/0229* (2013.01)

(58) Field of Classification Search

CPC ..... F28D 1/05366; F28D 2021/0091; F28F 9/0224

USPC ..... 165/175

See application file for complete search history.

(56) References Cited

U.S. PATENT DOCUMENTS

| | | | | |
|---|---|---|---|---|
| 7,557,460 | B2 | 7/2009 | Yugou | |
| 8,651,092 | B2 * | 2/2014 | Ghiani | F28D 7/1684 123/542 |

(Continued)

FOREIGN PATENT DOCUMENTS

| | | |
|---|---|---|
| CN | 1914473 A | 2/2007 |
| CN | 103913091 A | 7/2014 |

(Continued)

*Primary Examiner* — Joel M Attey

(74) *Attorney, Agent, or Firm* — James D. Miller; Shumaker, Loop & Kendrick, LLP

(57) ABSTRACT

A profile for a header of a cooler which also includes numerous parallel tubes. The parallel tubes have a cross-sectional shape between slots for the tubes which further include at least two wave troughs Further, the header is also included having such a profile. A cooler may also be provided, wherein the cooler has such a header.

12 Claims, 3 Drawing Sheets

(56) References Cited

U.S. PATENT DOCUMENTS

| | | | | |
|---|---|---|---|---|
| 8,790,808 | B2 * | 7/2014 | Herrmann | H01M 10/6557 165/104.33 |
| 10,139,443 | B2 | 11/2018 | Fouedjio et al. | |
| 2006/0144579 | A1 | 7/2006 | Ozaki | |
| 2006/0151158 | A1 * | 7/2006 | Ozaki | F28F 9/182 165/149 |
| 2008/0000626 | A1 * | 1/2008 | Sugito | F28F 9/0226 165/173 |
| 2014/0034028 | A1 | 2/2014 | Zhang et al. | |
| 2014/0174702 | A1 | 6/2014 | Kurz et al. | |
| 2015/0168080 | A1 * | 6/2015 | Honma | F28F 9/182 165/157 |
| 2018/0320995 | A1 | 11/2018 | Uno et al. | |

FOREIGN PATENT DOCUMENTS

| | | | |
|---|---|---|---|
| DE | 10025362 | A1 | 11/2000 |
| DE | 102006057851 | A1 | 6/2008 |
| DE | 102015205605 | A1 | 9/2016 |
| DE | 102017218526 | A1 | 4/2019 |
| JP | 2006189205 | A | 7/2006 |
| JP | 5821795 | B2 | 11/2015 |
| JP | 2017531149 | A | 10/2017 |

* cited by examiner

PROFILE FOR A HEADER OF A COOLER, A HEADER HAVING SUCH A PROFILE AND A COOLER HAVING A HEADER

CROSS-REFERENCE TO RELATED PATENT APPLICATIONS

This patent application is a United States national phase patent application based on PCT/KR2020/095066 filed on Apr. 13, 2020, which claims the benefit of German Patent Application No. DE 10 2019 207 905.9 filed on May 29, 2019, the entire contents of both of which are hereby incorporated herein by reference.

TECHNICAL FIELD

The invention relates to a profile for a header of a cooler, in particular for a motor vehicle, having at least one header.

BACKGROUND ART

Coolers for motor vehicles typically comprise numerous parallel tubes, in particular flat tubes, in which a coolant flows. This flow occurs in particular between two so-called headers which comprise suitable slots into which the numerous tubes that are soldered to the header are inserted.

These joints are subject to considerable strain, particularly when the temperature of the coolant changes quickly. In this case, there are considerable temperature differences between individual tubes, such that the tubes expand differently, which results in considerable strain on the joints between the tubes and the header. Damage in these areas is therefore the result of so-called thermal shocks.

DISCLOSURE OF INVENTION

In view of the above, the object of the invention is to provide a header and a cooler that are more resistant to thermal shocks.

The object is firstly achieved by the profile as shown and described herein. According thereto, this has a cross-sectional shape between the slots for the tubes which comprises at least two wave troughs. In the event of the strain described above, this results in a better distribution of the tension, so that resistance to thermal shocks is considerably improved. Initial tests show that resistance to thermal shocks is improved by a factor of 2-3.

Although it is sufficient for what is effectively a "double" fixing of the tubes by way of two wave troughs for two wave troughs with a crest between them to be provided, and for the slots for the tubes to extend between the two wave troughs, it is preferred that at least three wave crests are provided. In other words, this means that each wave trough is followed by a further wave crest. It should be noted in this regard that the wave troughs extend in the direction of the tubes, and the wave crests extend in the direction of the interior of the header or the water tank provided therewith. For the event that three wave crests are provided, the slots for the tubes extend from the two outer sides at least to the highest point of the outer wave crests.

Extensive tests have shown that what is important is the configuration of the individual radiuses of the waves. The values set out below apply to widths of the flat tubes of between 14 and 37 mm and/or a material thickness of the profile of the header according to the invention of between 1 and 2 mm, in particular approximately 1.5 mm, and/or a spacing between the tangents to the wave troughs and crests of approximately 4 to 6 mm. Thus, the values according to claims 3 and 4 are preferred for the radiuses, as it has been found that these values result in a particularly resistant joint between a header having the profile according to the invention and the flat tubes. With regard to the different radiuses, it should be noted that these are always measured on the inner side of the profile, i.e. facing away from the tubes, and an external or outer radius designates a radius that is closer to the outer side of the profile if the outer side is understood to be the point at which a wave running transversely through the profile begins. It should be mentioned in this respect that the cross-sectional shape of a profile is typically symmetrical with respect to a center in the aforementioned running direction of the wave.

It was also shown within the scope of the tests that it is also advantageous for longterm resistance to thermal shocks for at least one wave crest or trough to have at least one flat portion.

Within the scope of extensive tests the formulae according to claim 6 were determined for the widths of these flat portions. In this regard it should be stressed that only one of the values for W1 to W4 must be realized, and that this also applies to at least one of the radiuses R1 to R5.

As has been proven, the header according to the invention can consist of aluminum or an aluminum alloy.

This also applies to the numerous tubes, in particular flat tubes, which are preferably soldered to at least one header.

BRIEF DESCRIPTION OF DRAWINGS

In the following, embodiments of the invention that are shown in the drawings will be described in more detail. In the drawings.

DESCRIPTION OF EMBODIMENTS OF THE INVENTION

Figure 1:
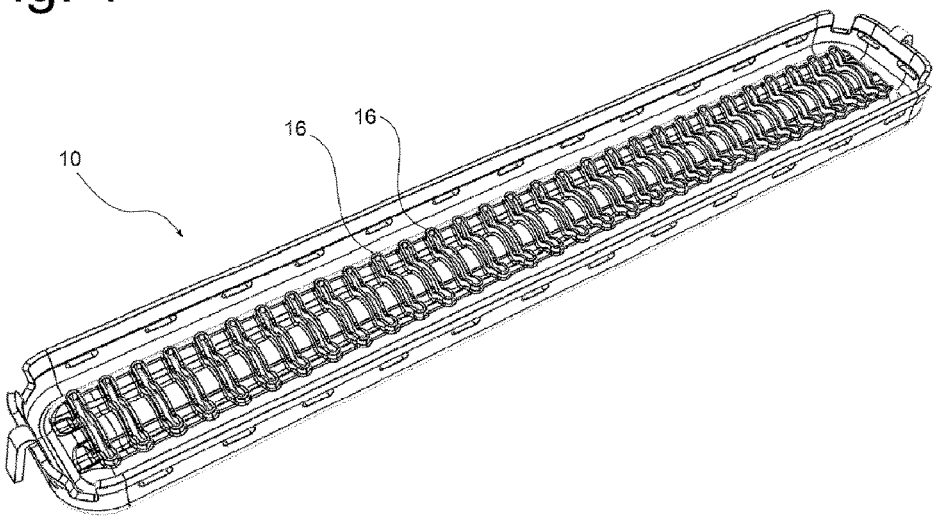
FIG. 1 shows a perspective view of a header according to the invention in a first embodiment.

As can be seen from FIG. 1, a profile according to the invention for a header 10 of a cooler has the form of a shallow dish with an elongated rectangular shape and rounded corners and edges. According to FIG. 1, the header 10 shown is closed on the upper side by a further header, such that the header 10 is formed, which is typically vertically oriented during operation. According to the orientation in FIG. 1, underneath the header 10 shown and when installed, typically in a horizontal direction, numerous flat tubes are inserted in slots 16 which are formed in the "base" of the header 10. The invention relates to the cross-sectional shape of the base, which effectively remains between the slots 16. The dimensions of the remaining base portions in a direction from bottom left to top right according to FIG. 1 are slightly larger, in particular 1.5 to 2.5 times as large as the dimensions of the slots 16 in the same direction.

Figure 2:
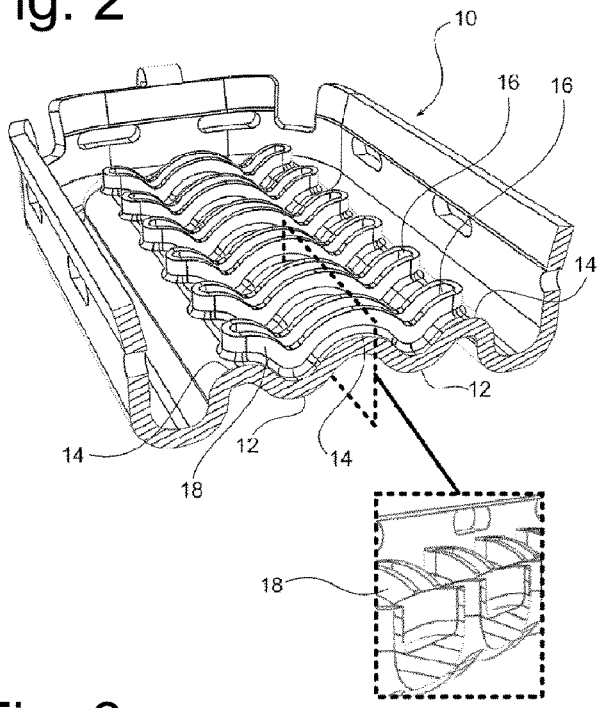
FIG. 2 shows a sectional view of the header shown in FIG. 1 with a detail enlargement.

FIG. 2 shows the wave shape of the base, and also the circumferential web 18 which surrounds each slot 16 and which essentially has a shape that corresponds to the flat tube to be inserted therein. As can be seen more clearly in FIG. 6, the web 18 has a considerable height H which preferably remains the same over the circumference and which ensures a secure soldered connection to the flat tubes to be inserted. The slots 16 and the webs 18 are typically formed by burring.

FIG. 2 shows the wave shape according to the invention of the header 10 between the slots 16, which in the case shown has two wave troughs 12, which are aligned with the flat tubes that are not shown, and three wave crests 14. The slots 16 extend approximately to the highest point of the two outer wave crests 14.

Figure 3:
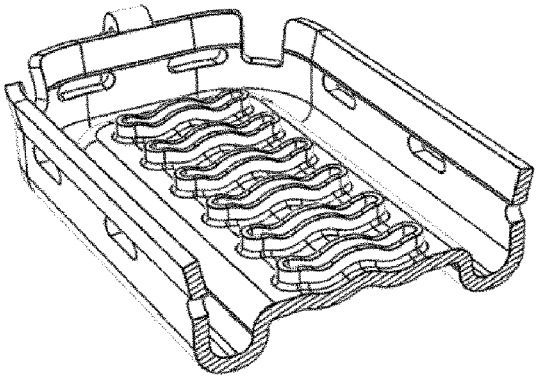
FIG. 3 shows a view of a further embodiment of the header according to the invention that corresponds to FIG. 2.
Figure 4:
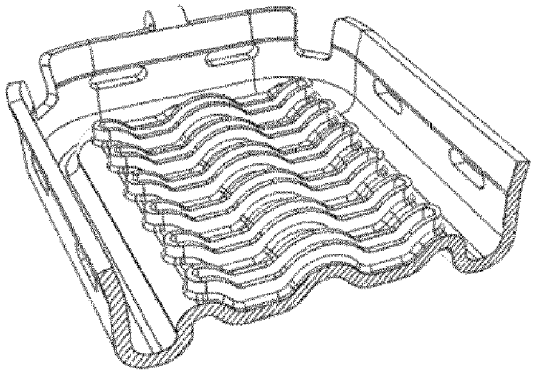
FIG. 4 shows a view of a further embodiment of the header according to the invention that corresponds to FIG. 2.
Figure 5:
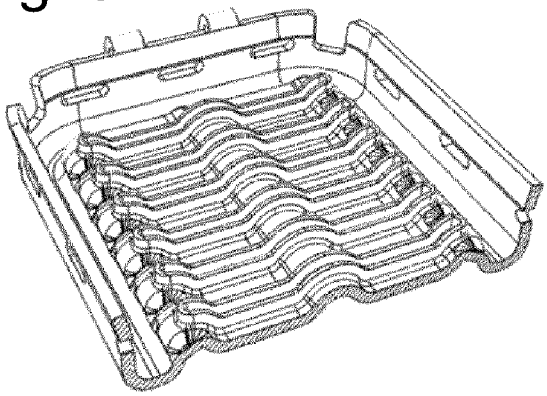
FIG. 5 shows a view of a further embodiment of the header according to the invention that corresponds to FIG. 2.

FIG. 2 shows the profile of the header 10 for flat tubes having a width (measured in FIG. 2 from left to right) of 18.5 mm, and FIG. 3 shows a profile for a width of 14 mm, FIG. 4 for a width of the flat tubes of 25.2 mm and FIG. 5 for a width of the flat tubes of 36.4 mm. As can be seen from FIG. 3, the waves here are slightly flatter, and in the embodiments according to FIG. 4 the wave crests are slightly drawn apart, as will be explained in more detail below with reference to FIG. 7 and FIG. 8.

Figure 6:
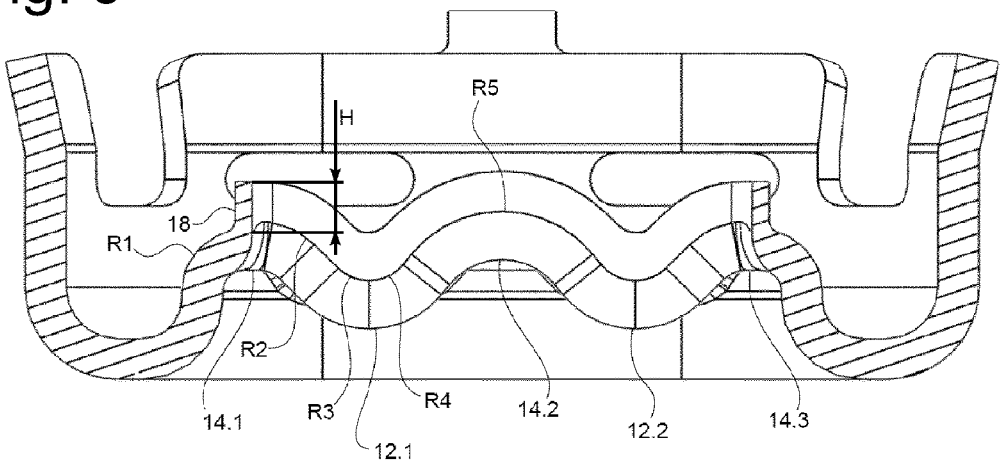
FIG. 6 shows a further sectional view of the header shown in FIG. 2.

In FIG. 6 the radiuses R1 to R5 are marked out, wherein it should first of all be stressed that these are always to be measured on the side facing away from the flat tubes (that are not shown). An exterior or outer radius is therefore to be understood to be a radius measured on the (lateral) outer side, in other words in FIG. 6 for the first wave crest 14.1 to the left. In contrast, an internal or inner radius, such as R2 in the case of the first wave crest 14.1 and R4 in the case of the first wave trough 12.1, is measured at a point further inwards (further to the right in FIG. 6). It should also be noted that the cross-sectional shape of the header 10 according to the invention, which can be seen in FIG. 6, is typically symmetrical to the center of the second, middle wave crest 14.2, such that the directions described (left/right) can be reversed for the right-hand half of the header 10 according to FIG. 6. The presently preferred values for a header profile for flat tubes having a width of 18.5 mm are: R1=2.3 mm, R2=2.6 mm, R3=1.9 mm, R4=1.9 mm and R5=4 mm.

Figure 7:
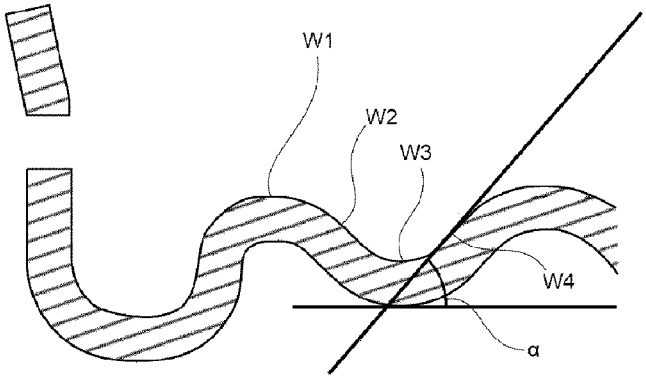
FIG. 7 shows a partial sectional view of the header shown in FIG. 2.

The flat portions specified in claim 6 are labelled in FIG. 7 and are shown for the profile in FIG. 6.

Figure 8:
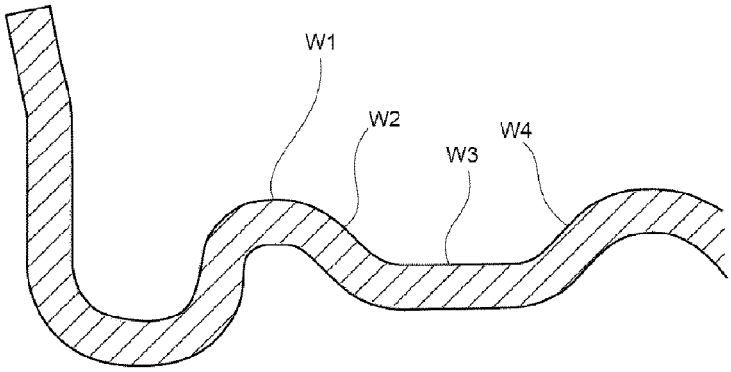
FIG. 8 shows a partial sectional view of the header shown in FIG. 4.

The profile in FIG. 8 corresponds to that in FIG. 4, in which there is a wider flat portion W3 corresponding to the preferred configuration.

The invention relates to a profile for a header of a coolerin particular for a motor vehicle, having at least one header.

The invention claimed is:

1. A header of a cooler which also comprises a plurality of parallel tubes, the header including a base having a plurality of slots formed therethrough with each of the slots receiving a corresponding one of the tubes therein, the slots spaced apart from each other along the base with respect to a longitudinal direction of the header and the tubes extending through the slots with respect to a height direction of the header arranged perpendicular to the longitudinal direction thereof, the base having a cross-sectional shape between adjacent ones of the slots which comprises at least two wave troughs and at least three wave crests with the wave crests and the troughs alternatingly formed in the base with respect to a width direction of the header arranged perpendicular to the longitudinal direction and the height direction thereof, wherein from outside to inside an outer radius (R1) of a first one of the wave crests, an inner radius (R2) of the first one of the wave crests, an outer radius (R3) of a first one of the wave troughs, an inner radius (R4) of the first one of the wave troughs and a radius (R5) of a second one of the wave crests measure as follows:

R1=1.5-3.5 mm,

R2=2-4 mm,

R3=1.9-5 mm,

R4=1.9-40 mm,

R5=3-50 mm, and wherein each of the slots extends in the width direction of the header from a first end disposed at a highest point of the first one of the wave crests with respect to the height direction of the header to a second end disposed at a highest point of a third one of the wave crests with respect to the height direction of the header with the first one of the wave crests and the third one of the wave crests forming outermost ones of the at least three wave crests with respect to the width direction of the header, and wherein the wave crests and the wave troughs are formed along an entirety of the base of the header with respect to the width direction of the header.

2. The header according to claim 1, wherein at least one of the wave crests or at least one of the wave troughs has at least one flat portion.

3. The header according to claim 1, wherein the header consists of aluminum or an aluminum alloy.

4. A cooler for an air-conditioning system of a motor vehicle, the cooler having the header according to claim 1.

5. The cooler according to claim 4, wherein the tubes consist of aluminum or an aluminum alloy, and are soldered to the header.

6. The header according to claim 1, wherein the first one of the wave crests forms an outermost portion of the base to a first side of the base and with respect to the width direction of the header, and wherein the third one of the wave crests forms an outermost portion of the base to a second side of the base and with respect to the width direction of the header.

7. The header according to claim 1, wherein the header further includes a perimeter trough extending around a perimeter of the base, and wherein the first one of the wave crests transitions directly to the perimeter trough at a first side of the base with respect to the width direction of the header and wherein the third one of the wave crests transitions directly to the perimeter trough at a second side of the base with respect to the width direction.

8. The header according to claim 1, wherein the highest point of the first one of the wave crests with respect to the height direction of the header is formed where a first portion of the first one of the wave crests defining the outer radius (R1) thereof intersects a second portion of the first one of the wave crests defining the inner radius (R2) thereof, and wherein the highest point of the third one of the wave crests with respect to the height direction of the header is formed where a first portion of the third one of the wave crests defining the outer radius (R1) thereof intersects a second portion of the third one of the wave crests defining the inner radius (R2) thereof.

9. The header according to claim 1, wherein each of the slots is surrounded by a corresponding web projecting from the base with respect to the height direction, and wherein each of the webs projects the same distance from the base with respect to the height direction across each of the wave crests and wave troughs of the base.

10. The header according to claim 1, wherein each of the slots is surrounded by a corresponding web projecting from the base with respect to the height direction, and wherein each of the webs has a profile shape corresponding to the cross-sectional shape of the base of the header between adjacent ones of the slots.

11. The header according to claim 1, wherein each of the slots is surrounded by a corresponding web projecting from the base with respect to the height direction, and wherein each of the webs includes a profile shape having wave crests corresponding to the wave crests formed in the base and wave troughs corresponding to the wave troughs formed in the base.

12. A header of a cooler which also comprises a plurality of parallel tubes, the header including a base having a plurality of slots formed therethrough with each of the slots receiving a corresponding one of the tubes therein, the slots spaced apart from each other along the base with respect to a longitudinal direction of the header and the tubes extending through the slots with respect to a height direction of the header arranged perpendicular to the longitudinal direction thereof, the base having a cross-sectional shape between adjacent ones of the slots which comprises at least two wave troughs and at least three wave crests with the wave crests and the troughs alternatingly formed in the base with respect to a width direction of the header arranged perpendicular to the longitudinal direction and the height direction thereof, wherein the wave crests extend in a direction of an interior of the header, wherein each of the slots extends in the width direction of the header from a first end disposed at a highest point of the first one of the wave crests with respect to the height direction of the header to a second end disposed at a highest point of a third one of the wave crests with respect to the height direction of the header with the first one of the wave crests and the third one of the wave crests forming outermost ones of the at least three wave crests with respect to the width direction of the header, wherein the wave crests and the wave troughs are formed along an entirety of the base of the header with respect to the width direction of the header, wherein webs surrounding the slots are provided, and wherein the slots and the webs are formed by burring.

* * * * *